United States Patent [19]

Hoge

[11] Patent Number: 5,052,210

[45] Date of Patent: Oct. 1, 1991

[54] FORGING DIE DESIGN AND METHOD FOR MAKING A FORGING DIE

[75] Inventor: Forrest W. Hoge, Ann Arbor, Mich.

[73] Assignee: Ford Motor Company, Dearborn, Mich.

[21] Appl. No.: 549,772

[22] Filed: Jul. 9, 1990

[51] Int. Cl.[5] ..... B21C 25/02; B21C 25/10

[52] U.S. Cl. ..... 72/467; 72/253.1; 76/107.1

[58] Field of Search ..... 72/467, 253.1, 260; 76/107.1

[56] References Cited

U.S. PATENT DOCUMENTS

| | | | |
|---|---|---|---|
| 3,186,210 | 6/1965 | Lesher | 72/467 |
| 3,713,323 | 1/1973 | Ivanier | 72/467 |
| 3,910,091 | 10/1975 | Samanta | 72/256 |
| 4,287,749 | 9/1981 | Bachrach | 72/467 |
| 4,350,865 | 9/1982 | Bachrach | 72/467 |
| 4,622,842 | 11/1986 | Bachrach | 72/467 |

FOREIGN PATENT DOCUMENTS

| | | | |
|---|---|---|---|
| 1048550 | 1/1959 | Fed. Rep. of Germany | 72/467 |
| 1172625 | 8/1985 | U.S.S.R. | 72/467 |

*Primary Examiner*—Daniel C. Crane

*Attorney, Agent, or Firm*—Frank G. McKenzie; Roger L. May

[57] ABSTRACT

A forging die and a forging die manufacturing method for extruding externally or internally splined helical gears wherein the lead end face of each die tooth includes a compound angle such that the end face will have two end surfaces. One end surface will project from the crown to the lead edge of the drive side of the die tooth and the other end surface will project from the crown to the coast side of the die tooth. Each end surface projects or is formed or defined by an included angle, A or B, as the case may be, as seen in FIGS. 6 and 7, taken relative to a section through the die teeth at the plane y parallel with the vertical axis of the die which is computed to ensure that the average directional flow of the material will produce a resultant vector in a direction parallel to the die teeth at any angle upon which the helical die teeth are formed. The compound angle of the die tooth end face is computed by geometrically determining the force vectors acting on the drive side and coast side end faces of any pair of adjacent die tooth and computing by solving two equations simultaneously the slope at which such end faces must be directed to ensure that the resultant force vector of the extruded gear blank is directed substantially parallel to the helix angle of the die.

13 Claims, 2 Drawing Sheets

FORGING DIE DESIGN AND METHOD FOR MAKING A FORGING DIE

TECHNICAL FIELD

This invention relates to forging die designs and methods of making the same, particularly cold forging dies for cold extruding helical gears.

BACKGROUND

As is well known, cold forging of various industrial parts is one of several forging techniques available to the artisan. In certain instances it offers particular advantages over hot forging techniques, for example, because it includes less expensive billet preparation and eliminates post forging processes such as descaling and the like. On the other hand, cold forging requires substantially higher forging forces to cause the metal to flow through the forging die. This produces significant stresses on the forging die itself and thus creates significant limitations on the process itself, including low die life and premature breakage. This is particularly true when forging helical gears, as opposed to spur gears, since the gear teeth are formed at an angle relative to the vertical axis of the die and this in turn produces a reaction force perpendicular to the axis of the forging die teeth which results in significant bending stresses and resultant early die failure. Particularly, this may result in the die teeth shearing at the lead end of the die as a result of substantial bending stresses.

It is known that these bending stresses can be reduced by allowing the die, or die punch, or both, to freely rotate during the forging stroke about the vertical axis of each. This reduces stress on the entire die and consequently on the lead end of the die teeth.

It is also known, as shown in U.S. Pat. No. 4,622,842, assigned to the assignee of the present invention, that the effect of this compressive force may be controlled by providing a compound angle at the lead end face of the die teeth such that one end face land constituting at least a major portion of the land is perpendicular to the helix and the remaining end face land is perpendicular to the die axis.

Beyond the above mentioned teachings, the art of reducing or controlling the compressive loads produced by forging, in the production of cold-forged gear blanks having internal or external gear teeth through careful gear die design, is not well known.

SUMMARY OF THE INVENTION

The present invention includes a gear die design for producing cold forged helical gear teeth that increases substantially gear die production life.

The invention further includes an improved gear die design that controls the directional flow of the extruded forged material in a manner that ensures the lowest possible bending stress upon the die teeth.

The invention includes further a method for constructing the lead end face of the die gear teeth in such a manner that the extrusion stresses are redistributed in a manner significantly increasing die life.

The method of the invention includes the step of constructing the lead end face of the die teeth to have a dual compound angle that resolves extrusion stresses down the die teeth in compression rather than across each tooth in bending, thereby resulting in increased die life.

The invention further includes a gear die design which may materially reduce the forces required to cold extrude a forging through a gear die.

The invention also includes a method for designing the structure of the die teeth in a manner which will ensure accomplishment of the aforesaid objectives.

In brief, in accordance with the invention the lead end face of the die teeth includes a compound angle such that the end face will have two end surfaces. One end surface will project from the crown to the lead edge of the drive die tooth and the other end surface will project from the crown to the coast side of the die teeth. Each end surface projects or is formed or defined by an included angle taken relative to a section through the die teeth at a plane parallel with the vertical axis of the die, which is computed to ensure that the average directional flow of the material will produce a resultant factor in a direction parallel to the die teeth at any angle upon which the helical die teeth are formed.

The above objects and other objects, features and advantages of the present invention are readily apparent from the following detailed description of the best mode for carrying out the invention when taken in connection with the accompanying drawings.

BEST MODE FOR CARRYING OUT THE INVENTION

In considering a specific description of the present invention, it is perhaps easiest to understand the present invention in light of what is believed to be the most relevant prior art, namely that shown in U.S. Pat. No. 4,622,842 as depicted in FIGS. 1-3.

Figure 1:
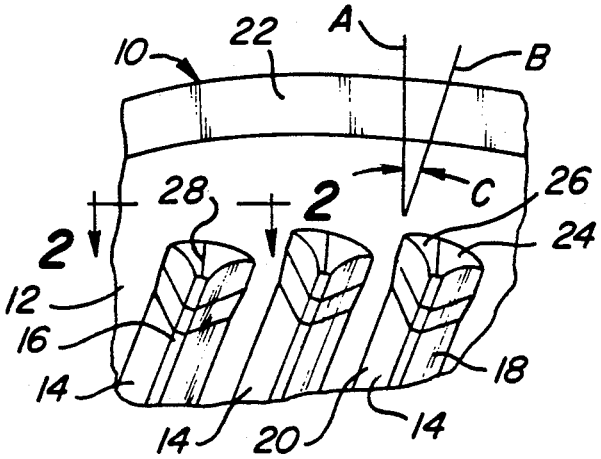
Fig-1 PRIOR ART
FIG. 1 is a partial view of the interior surface of an extrusion die showing helical die teeth viewed radially outward from the central axis of the die in accordance with a die structure previously known in the art.

In FIG. 1, there is shown a hollow die 10 having an internal cylindrical surface 12 and multiple adjacent helical die teeth 14 extending from the base of the tooth on the cylindrical surface radially inward toward the central axis of the die to the crest 16 of each tooth. Line A, at the base of the tooth is parallel to the central axis of the die. Line B, at the base of the tooth is parallel to the helix. The included angle defined by the intersection of lines A and B is the helix angle C. Each tooth has a face 18 on the coast side of the crest 16, and a face 20 on the drive side of the crest 16. The extrusion blank is inserted in the direction from the upper surface 22 of the die and forced downwardly in the direction of vector D, as seen in FIG. 2, which parallels the central axis, line A, of the die.

Figure 2:
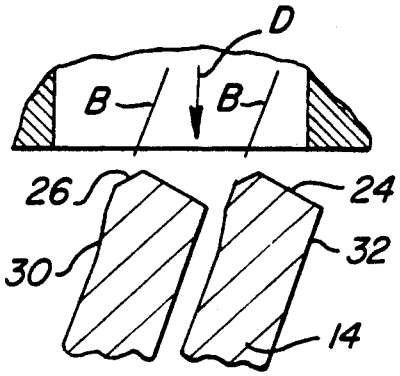
Fig-2 PRIOR ART
FIG. 2 is a cross section through the thickness of two adjacent die teeth taken along the lines 2—2 of FIG. 1.

As shown in FIGS. 1 and 2, the end face of each die tooth is divided into two plane surfaces 24 and 26 by a crown 28 extending from the base of the tooth to its crest. The first plane surface 24 is located on the coast side of the crown 28 and is to be inclined downwardly along a plane generally perpendicular to the helix axis B of the die. The second plane surface 26 located on the drive side of the crown is to be substantially perpendicular with the central axis A of the die. Whether there is provided a second plane surface 26 is optional as taught by the aforesaid patent, but if included in the design of the end face of each die tooth, it is taught that a successful die tooth configuration may result if the second plane surface or transition surface 26 and the first plane surface or end face 24 have approximately the same width when measured perpendicular to lands 30 and 32.

Figure 3:
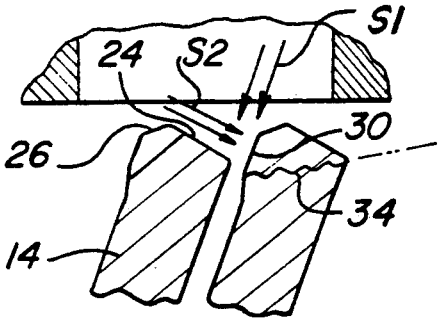
Fig-3 PRIOR ART
FIG. 3 is a view similar to FIG. 2 showing the direction and relative magnitude of extruded material flow, through the adjacent die teeth.
Figure 4:
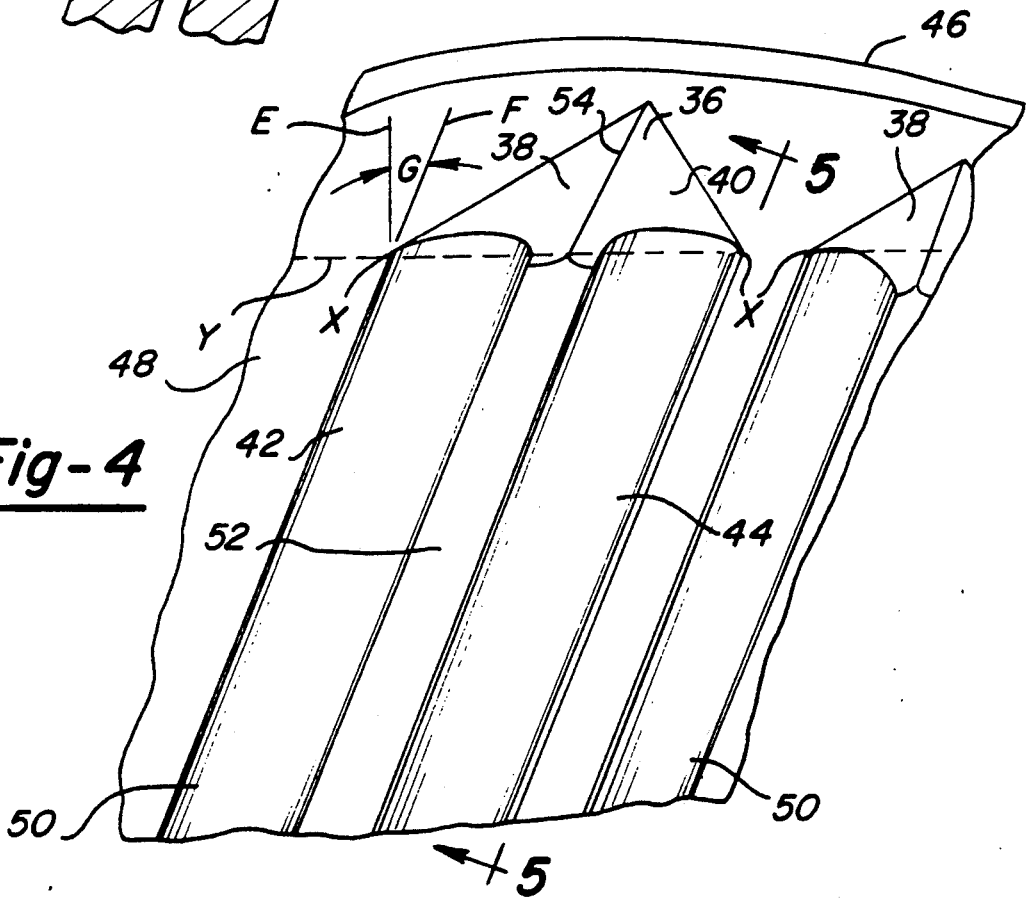
FIG. 4 is a partial view of the interior surface of an extrusion die showing helical die teeth viewed radially outward from the central axis of the die in accordance with, the present invention.
Figure 5:
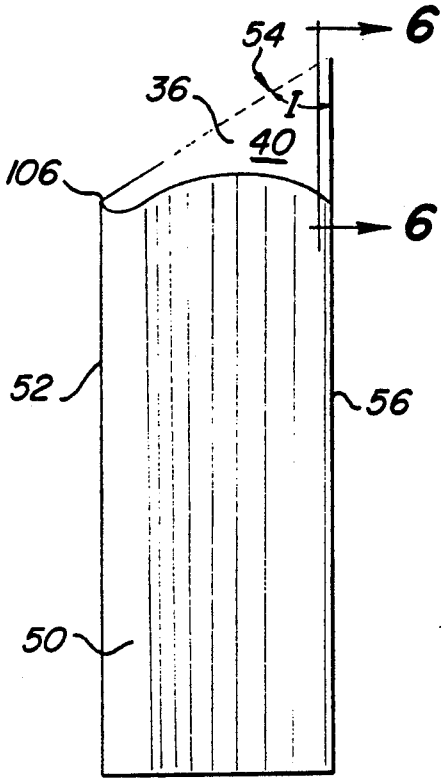
FIG. 5 is a cross section taken at lines 5—5 of FIG. 4.

In FIG. 3, there is shown a representation of the extrusion stresses S1, S2 which will be caused to develop as the die closes on the billet, extruding it through the die teeth 14 of FIGS. 1 and 2. It will be noted there is a substantial vector S2 in a direction parallel to the end face 24 which is perpendicular to the helix axis. It will also be noted that with or without the transition surface 26, the land 30 of the tooth adjacent the coast side of the adjoining die tooth represents a barrier confronting the material flow off of the adjoining end face. This then results in a substantial bending force being created on the die tooth 14 and a tendency towards fracture along the stress line 34 shown in FIG. 3.

Looking at the present invention, as shown in FIGS. 4–7, the extrusion stresses exerted on the die teeth 50 are significantly reduced by employing several unique design considerations.

First, it will immediately be noted that the end face 36 is divided into two planar sections 38 and 40, each of which is of approximately equal width and each extending at an acute angle substantially less than 90° relative to the helix angle G. It will also be noted that each planar section or face of each die tooth meets or intersects the drive side 42 or coast side 44, as the case may be, at approximately the same height or length as measured against the length of the helix axis F. In other words looking at FIG. 4, the point of intersection at which each planar face 38,40 of the end face meets the respective drive side or coast side of each die tooth is at the base of each die tooth at a point X. Each point X lies in a plane Y perpendicular to the central axis of the die. Such a construction leaves no barrier to resist material flow as it traverses each end face and adjacent die tooth.

Figure 6:
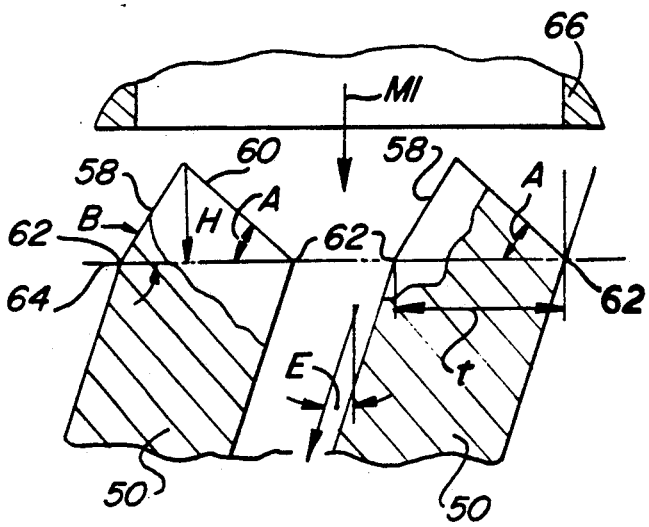
FIG. 6 is a cross section through the thickness of two adjacent die teeth taken at the surface 6—6 of FIG. 5.
Figure 7:
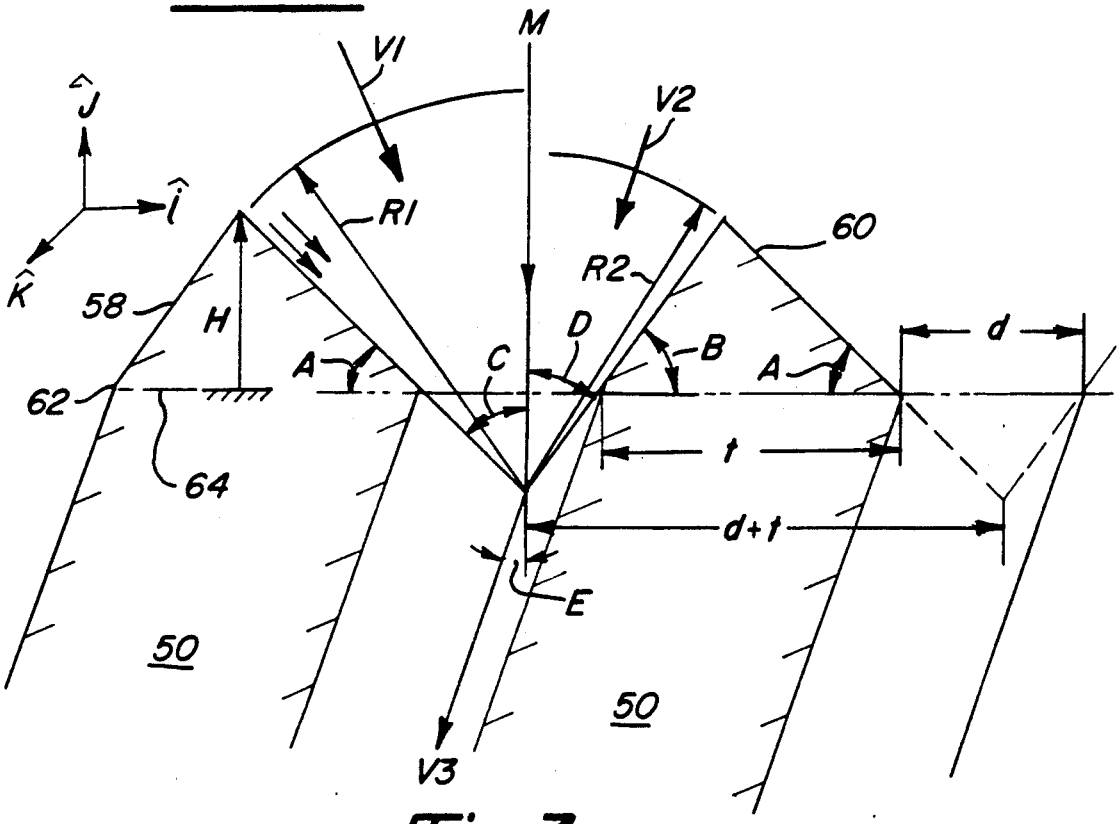
FIG. 7 is a view similar to FIG. 6 showing the geometric relationships between the two adjacent die teeth in accordance with the present invention.

Secondly, each of the two end surfaces constituting the end face of each die tooth is defined by an included angle, A or B, as the case may be, as seen in FIGS. 6 and 7, taken relative to a section through the die teeth at the plane Y parallel with the vertical axis of the die which is computed to ensure that the average directional flow of the material will produce a resultant vector in a direction parallel to the die teeth at any angle upon which the helical die teeth are formed.

Each of these features is discussed more fully below. Thus, at FIG. 4, there is shown a hollow die 46 having an internal cylindrical surface 48 and multiple adjacent die teeth 50 extending from the base of the tooth on the cylindrical surface radially inward towards the central axis of the die. Line E at the base of the tooth is parallel to the central axis of the die. Line F of each tooth is parallel to the helix of the gear die. Included angle G, which is defined by the intersection of lines E and F, is the helix angle of the die. The helix angle will vary dependent upon the gear design. However, a helix angle of 20–22° is common.

Each die tooth 50 includes a drive side surface 42 and a coast side surface 44 inclined radially inwardly towards the central axis of the die and intersecting one another at a crest 52 which forms the root of the gear to be extruded. The drive side surface 42 and coast side surface 44 may each be contoured so as to present a generally convex surface as viewed from the central axis of the die.

The end face 36 of each die tooth is divided into a first and second planar face 38 and 40, respectively, by a crown 54 defined by the intersection of the first and second planar faces 38 and 40 and extending from the base of the inner cylindrical surface to the crest 52 of the tooth. The crown 54 of each die tooth is inclined at a predetermined crown angle I, shown in FIG. 5, as measured radially outwardly from the base 56 of the gear tooth. The crown angle may range from 30° to 45° as may be selected as best for any particular gear application. A crown angle of approximately 35° is a normal industry standard.

Looking at FIG. 6, there is shown a cross section of two adjacent die teeth taken substantially at the base of each tooth. Each die tooth in the die is identical in geometric proportion. The intersection of the end face with the base of the tooth is defined by the lines 58 and 60, with the line 58 representing the intersection point of the first planar face 38 at the drive side of the tooth, and the line 60 representing the intersection of the second planar face 40 at the coast side of the tooth. An imaginary plane perpendicular to the central axis of the die is established which intersects the points of intersection of the planar faces of the end face of each die tooth with the respective drive side and coast side surfaces. This latter intersection point is represented by the numeral 62. The point at which this imaginary plane intersects the base of the tooth is shown by a line designated 64. Line 64 is intersected by the lines 58 and 60 to define included angles A and B, respectively. Angle A represents the coast side entrance angle. Angle B represents the drive side entrance angle. Vector M represents the direction of material flow of the extrusion blank 66 through the die. Where neither the punch nor die is rotated, the vector M will be applied in a direction parallel to the central axis of the die. Where either the die or punch is rotated, commonly the die, the angle at which vector M is applied will be determined by the relative rotation between the two such that vector M will be applied in a direction more closely approaching that of the helix.

Extrusion blank 66 is positioned above the die teeth and is adapted to move downwardly into the die teeth in the direction of vector M.

A principal purpose of the invention is to establish by the method of computation indicated below, the value for the included angles A and B. Angles A and B will be constant from the base of the tooth to the crest of the tooth. In other words, looking at FIG. 5 in particular, the point at which the crown 54 meets the crest 52 of the tooth lies on the above-mentioned imaginary plane which is substantially perpendicular to the central axis of the die.

In FIG. 7, a complete geometric and vector representation of the subject invention is shown. For purposes of illustration, the cross section shown in FIG. 7 is the same as the cross section shown in FIG. 6. Thus, like numerals or letters are used throughout to denote the same reference lines or design features. The dimensional characteristics of the die tooth design are represented as follows:

A=Coast Side Entrance Angle;
B=Drive Side Entrance Angle;
C=Coast Side Flow Angle measured from the coast side face 40 to the incoming material vector M;
D=Drive Side Flow angle measured from the drive side face 38 to the incoming material vector M;
d=equals the spacing between adjacent die teeth as measured along a plane extending perpendicular to the central axis of the die;
E=Angle of material extrusion, namely the helix angle;
H=Height of the crown 54 measured at the root of the die tooth;
R1=Shear Plane Radius 1; the "shear plane" being that point at which incoming material breaks up (shears) at the lead end of the end face (38,40);
R2=Shear Plane Radius 2;
t=equals the width of the die teeth at the root of the die tooth as measured in a plane perpendicular to the central axis of the die;
V1=Flow Vector 1;
V2=Flow Vector 2; and
V3=Resultant Flow Vector.

All linear measurements are in consistent units, e.g. millimeters, and all angles are measured in radians.

Given the foregoing, the objective as aforesaid is to determine by geometrical equations the values for included angles A and B; namely, the coast side angle A and the drive side angle B, such that the resultant extrusion flow vector V3 acts at an angle E, the helix angle.

The technique used is to solve two equations simultaneously, wherein the only unknowns are angles A and B. Given E and the gear geometry, one can thus solve the angles A and B such that resultant vector V3 acts at angle E. Thus:

Let:
V1=CR1 Acting at angle A+(C/2)
V2=DR2 Acting at angle B+(D/2)

Assume:
1) All vectors (Vi)=Force Fi=Stress * (area)
2) Stress=constant
3) The angle at which Fi acts is the average angle of C and D respectively
4) Incoming material is at 90° to horizontal $$\text{Then } V3 = -(\text{Sin}(A + C/2)V1 + \text{Sin}(B + D/2)V2)\ \text{Vector } j + (\text{Cos}(A + C/2)V1 - \text{Cos}(B + D/2)V2)\ \text{Vector } i$$

$$|V3| = [(\text{Vector } V1)^2 + (\text{Vector } V2)^2]^{178}$$

$$V1 = \text{Cos}(A + C/2)V1i - \text{Sin}(A + C/2)V1j$$

$$V2 = -\text{Cos}(B + D/2)V2i - \text{Sin}(B + D/2)V2j$$

$$|V3| = (V1)^2 + (V2)^2 + V1V2\text{Cos}(A + C/2 + B + D/2)$$

Defining a unit vector along V3 one obtains:

$$\frac{V3}{|V3|} = \frac{-(\text{Sin}(A + C/2)V1 - \text{Sin}(B + D/2)V2)i}{|V3|} + \quad (1)$$

-continued $$\frac{(\text{Cos}(A + C/2)V1 - \text{Cos}(B + D/2)V2)i}{|V3|}$$

Given it was elected that V3 should extend in the direction of helix angle E, it is also known that the same unit vector $$\frac{V3}{|V3|}$$

of equation (1) can be expressed as follows:

$$\frac{V3}{|V3|} = (\text{Cos}(E))\,i + (\text{Sin}(E))\,j \quad (2)$$

$$\frac{\text{Sin}(E)}{\text{Cos}(E)} = \text{Tan}(E) \quad (3)$$

By solving equations (1) and (2) for Sin(E) and Cos(E), one obtains by direct substitution into equation (3):

$$\frac{(\text{Sin}(B + D + C/2)\,CR1 + \text{Sin}(B + D/2)DR2)}{\text{Cos}(B + D + C/2)\,CR1 - \text{Cos}(B + D/2)DR2} = \text{TAN}(E) \quad (4)$$

Note: R1 and R2 are defined by:

$$R1 = \frac{H(1 + d/t)}{\text{Sin}(E + C)} \quad R2 = \frac{H(1 + d/t)}{\text{Sin}(B)}$$

It is also to be noted that angles A and B are interdependent, as defined by the geometric relationship:

$$C = -\tan^{-1}(H/(t-(H/\tan(90-D)))) - E$$

Note:

$$B + D = 90 \quad (5)$$

$$B + D/2 = 90 - D/2$$
$$A = 180 - (B + C + D)$$

Therefore: Substituting equations for R1 and R2 into (4) and then proceeding to solve equations (4) and (5) simultaneously will give the compound angles A and B necessary to cause material to extrude at angle E.

Due to the intractability of the equations (4) and (5), an iterative technique is used to solve them simultaneously. In general, for helix angles ranging from 20°-30°, which is common for most helical gears, the combination of angles A and B to be selected will include an angle A falling within the range of 55 to 75 degrees and an angle B falling within the range of 20 to 40 degrees.

The iterative solution technique is well known as the Newton-Raphson technique. One commercially available software program useful in computing in accordance with this technique is "TK Solver" available from Universal Technical Systems, Inc.

The following is an example of one such computation solving for a helical gear tooth design wherein:

E=22°
H=2.48 mm
t=5.25 mm

Solving simultaneously for equations 1 and 2 above, angles A and B compute to 65.6° and 31.0°, respectively. Since the solution for the combination of angles A and B is iterative, there are other possible combinations. However, the above-mentioned values are the only plausible solution, being one at which the selected compound angles will form planar surfaces directed at a substantially acute angle relative to the central axis of the die.

It will be appreciated that the degree of inclination of the first and second planar faces of the die tooth end face will give a specific value for both the included angle A and the included angle B. Theoretically, this will constitute a geometric computation based on the resultant vector V3 being precisely parallel to the helix angle which, at least theoretically, will mean that the material flow is in pure compression. In actual practice, of course, nothing is nearly this perfect. Within the scope of the invention, it is quite acceptable that the included angles be within plus or minus 5° of the value determined by the above mentioned equation. For all practical purposes and known applications, this will yield a result wherein the resultant vector is substantially parallel with the helix angle. Consequently, throughout this range of plus of minus 5° on either or both of the included angles A and B, the material flow will be in substantial compression with a minimal bending component.

Further, given this latitude in the selection of actual values of the angles A and B to be used, it is desirable from the standpoint of manufacturing the gear die, that the crown 54 be parallel to the helix angle. Since there is a range permitted in the selection of the included angles A and B, the crown angle can be adjusted, in most instances, so that it will be parallel with the helix angle.

While the best mode for carrying out the invention has been described in detail, those familiar with the art to which this invention relates will recognize alternative designs and embodiments for practicing the invention. Thus, the above described preferred embodiment is intended to be illustrative of the invention which may be modified within the scope of the following appended claims.

I claim:

1. A cylindrical die for cold extruding helical gears and having a cylindrical surface and spaced helically arranged die teeth extending radially from said cylindrical surface relative to the central axis of said die and extending lengthwise of the die along a helix axis, said die having an inlet end adapted to receive a cylindrical billet of predetermined outer diameter and length and an outlet end from which the billet is expelled following extrusion of the billet through said die teeth thereby forming a gear body having circumferentially arranged helical gear teeth;

said die teeth being equally spaced relative to one another about the circumference of said cylindrical surface;

said die teeth each having an end face nearest the inlet end of the die, a base located on said cylindrical surface and a crown located radially of the base and being inclined toward said outlet end at a predetermined crown angle relative to the base;

each said end face including stress directing means for resolving and directing extrusion stresses placed on the die teeth by said billet in a direction parallel to said helix axis;

each said end face including a first planar face and a second planar face intersecting one another at a crown and extending across a portion of the width of the die at said inlet end, said first planar face and said second planar face being directed at a first preselected angle and a second preselected angle, respectively, relative to a plane perpendicular to said central axis and beginning at said base;

said first planar face of one die tooth and said second planar face of the next adjacent die tooth being directly opposed from one another and the respective first and second preselected angles of each opposed planar face constituting in combination said stress directing means whereby the resultant magnitude of the extrusion force and direction of extruded material flow of said billet will be parallel to said helix axis thereby causing said extruded material to flow between said opposing gear teeth substantially in compression.

2. The invention of claim 1 wherein each said planar face intersecting a respective coast side face or drive side face begins at a point on said cylindrical surface lying in a common plane perpendicular to the central axis of the die and extending radially of the central axis of the die at said predetermined crown angle.

3. A cylindrical die for cold extruding helical gears and having a cylindrical surface and spaced helically arranged die teeth extending radially from said cylindrical surface relative to the central axis of said die and extending lengthwise of the die along a helix axis, said die having an inlet end adapted to receive a cylindrical billet of predetermined outer diameter and length and an outlet end from which the billet is expelled following extrusion of the billet through said die teeth thereby forming a gear body having circumferentially arranged helical gear teeth;

said die teeth being equally spaced relative to one another about the circumference of said cylindrical surface and having a coast side face and a drive side face dependent on the direction the gear to be formed on the die is to be driven;

said die teeth each having an end face nearest the inlet end of the die, a base located on said cylindrical surface and a crown located radially of the base and being inclined toward said outlet end at a predetermined crown angle relative to the base;

each said end face including stress directing means for resolving and directing extrusion stresses placed on the die teeth by said billet in a direction parallel to said helix axis;

each said end face including a first planar face and a second planar face intersecting one another at a crown and extending across a portion of the width of the die at said inlet end, said first planar face and said second planar face being directed at a first preselected angle and a second preselected angle, respectively, relative to a plane perpendicular to said central axis and beginning at said base;

said first and second preselected angles being of a value equal to that determined in accordance with the following equations solved simultaneously:

$$\frac{(\mathrm{Sin}(B + D + C/2)\ CR1 + \mathrm{Sin}(B + D/2)DR2)}{\mathrm{Cos}(B + D + C/2)\ CR1 - \mathrm{Cos}(B + D/2)DR2} = \mathrm{TAN}(E) \quad (1)$$

$$C = \tan^{-1}(H/(t-(H/\tan(90-D)))-E \quad (2)$$

where

A = Coast Side Entrance Angle;

B = Drive Side Entrance Angle;

C = Coast Side Flow angle measured from the coast side face 40 to the incoming material vector M;

D = Drive Side Flow angle measured from the drive side face 38 to the incoming material vector;

d = equals the spacing between adjacent die teeth as measured along a plane extending perpendicular to the central axis of the die;

E = Angle of material extrusion, namely the helix angle;

H = Height of the crown 54 measured at the root of the die tooth;

R1 = Shear Plane Radius 1; the "shear plane" being that point at which incoming material breaks up (shears) at the lead end of the end face (38,40);

R2 = Shear Plane Radius 2;

t = width of the die teeth at the root of the die tooth as measured in a plane perpendicular to the central axis of the die;

wherein the value of included angles A and B are within plus or minus 5° of the computed value of each.

4. The invention of claim 3 wherein said crown angle is from about 30° to about 45°.

5. The invention of claim 3 wherein the crown is disposed at an angle substantially parallel with the helix axis.

6. A cylindrical, hollow die for cold extruding helical gears and having spaced helically arranged die teeth extruding radially inwardly from the cylindrical inner surface of the die toward the axis of said die and extending lengthwise of the die along a helix axis, said die having an inlet end adapted to receive a cylindrical billet of predetermined outer diameter and length and an outlet end through which the billet is expelled following extrusion of the billet through said die teeth thereby forming a gear body having externally arranged helical gear teeth;

said die teeth being equally spaced relative to one another about the circumference of said inner surface;

said die teeth having an end face nearest the inlet end of the die, a base located on said inner surface and a crown located radially inward from the base and inclined toward said outlet end at a predetermined crown angle relative to the base;

each said end face including stress directing means for resolving and directing extrusion stresses placed on the die teeth by said billet in a direction parallel to said helix axis;

each said end face including a first planar face and a second planar face intersecting one another at a crown and extending across a portion of the width of the die at said inlet end, said first planar face and said second planar face being directed at a first preselected angle and a second preselected angle, respectively, relative to a plane perpendicular to said central axis and beginning at said base;

each die tooth including a drive side surface and a coast side surface intersecting at a crest;

said crown extending from said base to said crest;

each said drive side surface and coast side surface intersecting said first and second planar surfaces respectively at said crest and said base at a singular plane disposed perpendicularly to said central axis; and said first and second preselected angles being of a value equal to that determined in accordance with the following equations solved simultaneously:

$$\frac{(\mathrm{Sin}(B + D + C/2)\,CR1 + \mathrm{Sin}(B + D/2)DR2)}{\mathrm{Cos}(B + D + C/2)\,CR1 - \mathrm{Cos}(B + D/2)DR2} = \mathrm{TAN}(E) \quad (1)$$

$$C = -\tan^{-1}(H/\tan(90 - D))) - E \quad (2)$$

where

A = Coast Side Entrance Angle;

B = Drive Side Entrance Angle;

C = Coast Side Flow angle measured from the coast side face 40 to the incoming material vector M;

D = Drive Side Flow angle measured from the drive side face 38 to the incoming material vector;

d = equals the spacing between adjacent die teeth as measured along a plane extending perpendicular to the central axis of the die;

E = Angle of material extrusion, namely the helix angle;

H = Height of the crown 54 measured at the root of the die tooth;

R1 = Shear Plane Radius 1; the "shear plane" being that point at which incoming material breaks up (shears) at the lead end of the end face (38,40);

R2 = Shear Plane Radius 2;

t = width of the die teeth at the root of the die tooth as measured in a plane perpendicular to the central axis of the die;

wherein the value of included angles A and B are within plus or minus 5° of the computed value of each.

7. The invention of claim 6 wherein said crown angle is from about 30° to about 45°.

8. The invention of claim 6 wherein said crown angle is from about 30° to about 45°.

9. The invention of claim 6 wherein the crown is disposed at an angle substantially parallel with the helix axis, and wherein the value of included angle A and B are within plus or minus 5° of the computed value of each.

10. The invention of claim 6 wherein each die tooth includes a drive side surface and a coast side surface intersecting at a crest, said crown extending from said base to said crest, each said drive side surface and coast side surface intersecting said first and second planar surfaces respectively at said crest and said base at said plane.

11. A method of making a cylindrical die for cold extruding helical gears, said cylindrical die having spaced helically arranged die teeth extruding radially from the cylindrical surface of the die relative to the central axis of said die and extruding lengthwise of the die along a helix angle, said die having an inlet end adapted to receive a cylindrical billet of predetermined outer diameter and length and an outlet end from which the said billet is expelled following the billet being extruded through said die teeth thereby forming a gear body having circumferentially arranged helical gear teeth;

said die teeth being equally spaced relative to one another about the circumference of said cylindrical surface;

said die teeth each having an end face nearest the inlet end of the die, a base located on said cylindrical surface and a crown located radially of the base and being inclined toward said outlet end at a predetermined crown angle relative to the base;

said die teeth each including a drive side surface and a coast side surface intersecting at a crest;

said crown extending from said base to said crest;

forming said end face of each said die tooth to include a first planar face and a second planar face intersecting one another at said crown and extending across a portion of the width of the die at said inlet end;

forming said first planar face and said second planar face to be directed at a first preselected angle and a second preselected angle, respectively, relative to a plane perpendicular to said central axis and beginning at said base;

equating said first and second preselected angles in accordance with the following equations solved simultaneously:

$$\frac{(\mathrm{Sin}(B + D + C/2)\, CR1 + \mathrm{Sin}(B + D/2)DR2)}{\mathrm{Cos}(B + D + C/2)\, CR1 - \mathrm{Cos}(B + D/2)DR2} = \mathrm{TAN}(E) \quad (4)$$

$$C = -\tan^{-1}(H/(t-(H/\tan(90-D)))) - E \quad (5)$$

where

A = Coast Side Entrance Angle;

B = Drive Side Entrance Angle;

C = Coast Side Flow angle measured from the coast side face 40 to the incoming material vector M;

D = Drive Side Flow angle measured from the drive side face 38 to the incoming material vector M;

d = equals the spacing between adjacent die teeth as measured along a plane extending perpendicular to the central axis of the die;

E = Angle of material extrusion, namely the helix angle;

H = Height of the crown 54 measured at the root of the die tooth;

R1 = Shear Plane Radius 1; the "shear plane" being that point at which incoming material breaks up (shears) at the lead end of the end face (38,40);

R2 = Shear Plane Radius 2;

t = width of the die teeth at the root of the die tooth as measured in a plane perpendicular to the central axis of the die;

wherein the value of included angles A and B are within plus or minus 5° of the computed value of each.

12. The method of claim 11 further including forming each said end face at said first and second preselected angles A and B being within plus or minus 5° of the computed value of each.

13. The method of claim further including forming said crown at an angle substantially parallel with the helical axis.

* * * * *

UNITED STATES PATENT AND TRADEMARK OFFICE

CERTIFICATE OF CORRECTION

PATENT NO. : 5,052,210

DATED : October 1, 1991

INVENTOR(S) : Forrest W. Hoge

It is certified that error appears in the above-identified patent and that said Letters Patent is hereby corrected as shown below:

Column 5, line 56, the formula should read as follows:

$$V3 = [(\text{Vector } V1)^2 + (\text{Vector } V2)^2]^{\frac{1}{2}}$$

Column 12, line 21, Claim 13, after "claim" insert "11".

Signed and Sealed this

Twenty-sixth Day of January, 1993

*Attest:*

STEPHEN G. KUNIN

*Attesting Officer*

*Acting Commissioner of Patents and Trademarks*